United States Patent [19]

Henrich et al.

[11] Patent Number: 4,883,323

[45] Date of Patent: Nov. 28, 1989

[54] LONGWALL MINING MACHINE FOR THE MINING OF THICK MINERAL SEAMS

[75] Inventors: Friedhelm Henrich, Bochum; Werner Hellmuth, Dortmund, both of Fed. Rep. of Germany

[73] Assignee: Gebr. Eickhoff Maschinenfabrik und. Eisengieberei mbH, Fed. Rep. of Germany

[21] Appl. No.: 261,363

[22] Filed: Oct. 24, 1988

[30] Foreign Application Priority Data

Oct. 29, 1987 [DE] Fed. Rep. of Germany ..... 3736609

[51] Int. Cl.[4] ..... E21B 25/10

[52] U.S. Cl. ..... 299/42; 299/53

[58] Field of Search ..... 299/29, 42, 43, 44, 299/51, 52, 53

[56] References Cited

U.S. PATENT DOCUMENTS 3,907,367 9/1975 Nokajima ..... 299/53
4,465,319 8/1984 Brownlie ..... 299/42

FOREIGN PATENT DOCUMENTS 2132256 7/1984 Fed. Rep. of Germany ..... 299/42
3527253 11/1986 Fed. Rep. of Germany .

*Primary Examiner*—Stephen J. Novosad
*Assistant Examiner*—David J. Bagnell
*Attorney, Agent, or Firm*—Clifford A. Poff

[57] ABSTRACT

A drum cutter mining machine translatable along a longwall conveyor includes an auxiliary cutting drum for breaking up pieces of mineral carried by the longwall conveyor system. The auxiliary cutting drum is supported by a jib and an arm extension affixed in a fixed relationship with a support arm. The auxiliary cutting drum is positioned by the same actuator which pivotally positions the drum-cutter cutting drum at a desired cutting height at the mine roof and other times at the floor. Positioning of the cutting drum at the desired cutting height automatically positioned the auxiliary cutting drum.

6 Claims, 4 Drawing Sheets

LONGWALL MINING MACHINE FOR THE MINING OF THICK MINERAL SEAMS

BACKGROUND OF THE INVENTION

1. Field of the Invention

The present invention relates generally to mining machines utilized in longwall mining operations and, more particularly, to an improved drum-cutter mining machine utilizing an auxiliary cutting drum for operating on mined material carried by a conveyor used for supporting the mining machine.

2. Description of the Prior Art

Underground mining operations frequently utilize a mining process referred to as longwall mining in order to most efficiently shear a mineral from a mineral seam.

Longwall mining procedures utilize a drum-cutter mining machine, also referred to as a shearer loader, which is positioned proximate to a mineral seam in a mine wall. The drum-cutter mining machine includes a machine body and cutting drums rotatably supported by support arms extending from opposite ends of the machine body wherein the support arms are pivotally connected to the machine body. The support arms are pivoted about their respective pivotal connections to the machine body in order to position the cutting drums at desired cutting heights. Preferably, a first drum, the leading cutting drum, is positioned to shear an upper portion of the mineral seam, and a second drum, the trailing cutting drum, is positioned to cut a lower portion of the mineral seam along the floor of the mine. By pivoting the respective support arms about their pivotal connections to the machine body, the vertical positioning of the respective cutting drums may be altered. When the mineral is to be sheared from the mine seam, drive motors provide rotational torque to the respective cutting drums. The leading cutting drum thereby shears a first portion of the mine wall, and the trailing cutting drum shears a second portion of the mine wall. The drum-cutter mining machine is translated along the length of the mine seam face upon a longwall conveyor system that includes a rack structure supported by the conveyor and extending along the entire length of the mine wall face. A drive motor in the machine body drives gearing to meshingly engage with individual rack pins of the rack structure to thereby allow translation of the mining machine therealong.

West German Pat. No. 35 27 253 discloses a drum-cutter mining machine equipped with an auxiliary cutting drum. The mining machine is movable along a longwall conveyor. Two support arms pivotally supported by the frame of the mining machine at opposite ends thereof rotatable support cutting drums. The cutting drums are situated on the side of the support arms which face the coal face, and on the opposite side, the goaf side, the cutting drums support drive motors which are connected by gearing to the respective cutting drums for rotation thereof. The cutting drum and the drive motor are arranged on each of the support arms such that the rotational axis of the motor and the rotational axis of the cutting drum are parallel to each other. A jib is pivotally supported on the front free face of the motor. An actuator also extends between the jib and the front face of the motor to impart pivotal movements to the jib. The end of the jib projecting below the drive motor and under the cutting drum carries an auxiliary drum which is drivingly connected by gearing to a butt shaft portion of the motor shaft at the goaf side of the support arm. The connection between the auxiliary drum and the drive motor is formed by a train of gears that extends inside the jib.

Drum-cutter machines used to release coal from thick mine seams are required to operate with cutting drums having large diameters and also provided with drum support arms having a greater length that extends over the radius of the drum. In this way, the drums can be positioned throughout the entire required range of cutting to release material from the thick mine seam. When mining such thick seams, the material loosened by the cutting drums breaks down in large layers which are caught by the conveying elements of the longwall conveyor and pressed against the area of the mining machine bridging the conveyor. This condition leads to jamming, the creation of obstructions and interruptions to working of the mine seam.

The support arms of such a drum-cutter mining machine have a length required to carry the cutting drum through a large pivotal movement in order to cut away coal at the roof of the coal seam while the mining machine travels in one direction, and to cut away coal at the floor of the mine seam through operation of the same cutting drum when the direction of travel by the mining machine is reversed. The drive motor for the cutting drum participates in the pivotal movement of the support arm because it is fastened to the support arm and also carries the jib which is connected thereto as well as the auxiliary drum which is connected to the jib. For this reason, an adjustment device is necessary to constantly bring the jib into a position in which the auxiliary cutting drum can fulfill its function of breaking up portions of debris on the conveyor at the portion of the mining machine bridging the conveyor.

It is accordingly the object of the present invention to provide a mining machine particularly a mining machine constructed for mining thick seams in which an auxiliary cutting drum may be properly positioned without an independent actuator of the drum positioning actuator.

SUMMARY OF THE INVENTION

According to the present invention, there is provided a drum cutter mining machine for releasing material from a thick mine seam while traversed along a conveyor, the drum cutter mining machine including the combination of: a machine body including body portion traversing the conveyor above a material transportation portion while moving back and forth along the conveyor; a support arm pivotally connected to the machine body at an end thereof for leading and trailing with respect to movement of the machine body along the conveyor; a cutting drum rotatably supported by an extended end portion of the support arm for releasing material from the mine seam; a drive motor for rotating the cutting drum, the drive motor being supported above the conveyor by the support arm for allowing passage of debris on the conveyor beneath the drive motor and the body which bridges the conveyor; a jib secured to a surface of the drive motor which is turned away from the support arm for support thereby; an auxiliary cutting drum rotatably mounted at an extend end of the jib which projects from the drive motor; gear means for drivingly interconnecting the drive motor and the auxiliary cutting drum; the jib having an extended length such that the auxiliary drum is situated thereby below the axis of pivotal movement formed by the pivot when the support arm is in a central position to its range of pivotal movement ranging between operation of the cutting drum at the mine rod and at the mine floor; and means supported by the machine body and connected to the support arm for pivoting the support arm to locate the cutting drum carried thereby for operation at the roof of the mineral seam and at other times at the floor of the mineral seam, the auxiliary cutting drum being concurrently positioned by operation of the means from a position below the pivotal axis to operating positions where the operating height of the auxiliary cutting drum above the conveyor is substantially the same independently of whether the cutting drum is operating at the roof o the floor of the coal seam.

Thus, it can be seen according to the present invention there is provided an improved drum cutter mining machine over the known form of cutting machine described herein by providing that the jib which carries the auxiliary cutting drum is dimensioned as the extended length thereof and arranged such that the auxiliary cutting drum is situated beneath the pivot axis for the support arm when the support arm is positioned midway, centrally, of the range of pivotal movement. Because of this arrangement, the auxiliary cutting drum is situated directly in front of the opening which is beneath the portion of the machine body bridging the conveyor and immediately below the pivotal axis of the support arm. Pivotal movement of the support arm from the central position into operating positions produce only slight variations to the elevated positions at which the auxiliary cutting drum is moved. Thus, it can be seen that a special mechanism required heretofore to compensate for the variations to the operating height of the auxiliary cutting drum at various pivoted positions by the support arm is unnecessary.

According to a further feature of the present invention, the machine body is provided with an inlet situated underneath the pivot axis for the support arm. The inlet has dimensions including the depth of the inlet extending beyond the pivot axis of the support arm determined by the radius of the auxiliary cutting drum and path of pivotal movement of the auxiliary cutting drum produced when the support arm is lowered by one half of the pivotal operating range of the support arm. During descending movement by the support arm, the auxiliary cutting drum moves into the space formed by the inlet without colliding with the frame or body of the mining machine.

It is advantageous to rotatably support both sides of the auxiliary cutting drum from the support arm of the drum cutter loader or an extension of the support arm. The auxiliary cutting drum is carried from the side of the support arm which is turned away from the jib. Such a mounting arrangement increases the resistance capability of the mounting for the auxiliary cutting drum and renders the mounting insensitive to intermittent loads which are unavoidable when coarse debris is produced by the mining operation. To this end, the support arm or a support arm extension can be provided with a detachably arranged shoulder situated on the other side of the arm or arm extension to extend underneath the pivot axis for the arm.

It is possible, however, to design the shoulder and support arm as a unit wherein the support arm shoulder takes the form a housing provided with spur gear wheels which drivingly interconnect the auxiliary drum to a gear train in the support arm. In one arrangement of this type, the gearing which transmits the rotational movement to the auxiliary cutting drum is coordinated with the support arm. The lubrication of the gearing is therefore also provided by the oil supply circuit in the support arm. It is unnecessary to utilize a butt shaft of the drive motor which is otherwise essential according to an arrangement wherein the gearing for the auxiliary drum is situated inside the jib.

An embodiment of the present invention provides that the support arm for the drum cutter loader includes a protective housing connected to the support arm and receiving the drive motor. The housing adjoins the sidewall of the support arm and extends downwardly so that spur gears supported in the housing can drivenly engage the shaft of the auxiliary cutting drum which is to be driven and face toward the support arm. In this instance, the driven shaft of the auxiliary cutting drum is supported by the housing. The gearing interconnects the drive shaft of the auxiliary drum and the butt output shaft of the driving motor. A cover is provided for the jib and the cover retains the end of the drive shaft for the auxiliary cutting drum at the goaf side. The cover seals the protective housing on the front face which is turned away from the support arm. The protective housing is flange mounted on the support arms so that the auxiliary cutting drum is situated underneath the pivotal axis of the support arm when the support arm is in the central pivotal position is of pivotal range.

BRIEF DESCRIPTION OF THE DRAWINGS

The present invention will be better understood when the following description is read in light of the accompanying drawings in which.

DESCRIPTION OF THE PREFERRED EMBODIMENTS

Figure 3:
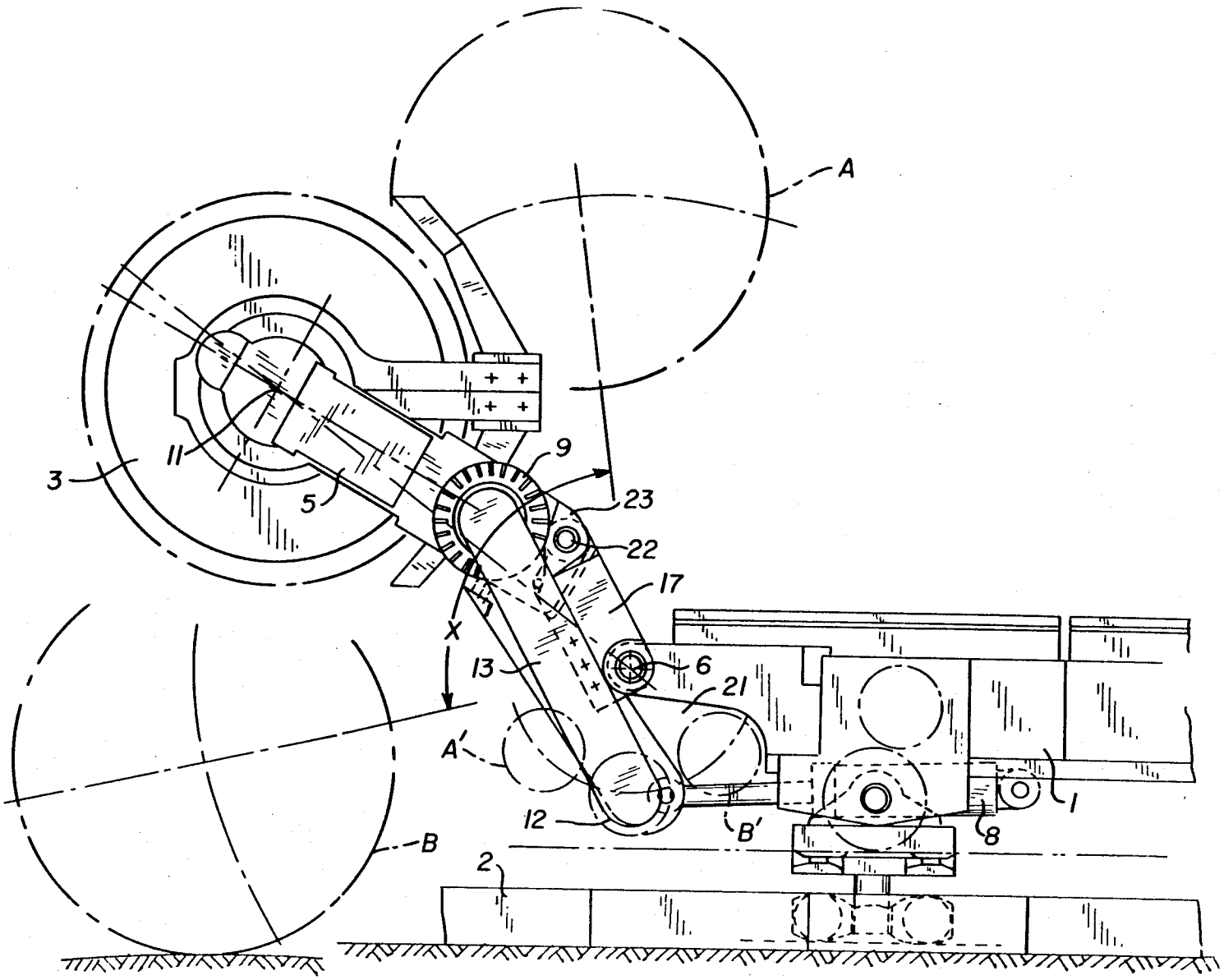
FIG. 3 is an elevational view similar to FIG. 1 and illustrating a further embodiment of the drum-cuter mining machine of the present invention.

In the embodiments shown in the drawings, a drum cutter loader 1 is situated above a longwall conveyor means 2, such as a face conveyor, for releasing coal from a mine seam 4, by operation of a cutting drum 3 while the mining machine is traversed along the conveyor. The cutting drum 3 is supported at the extended end of a support arm 5 for rotation about an axis which is generally parallel with the mine floor. The support arm 5 is carried at an end of a machine frame by pivot shaft 6 for pivotal movement about a pivot axis centrally located along the length of the pivot shaft. The pivot shaft extends across the width of the mining machine such that the pivot axis is generally parallel with the mine floor. The cutting drum is positioned by the operation of a piston and cylinder assembly 8 which has its cylinder end mounted by a clevis arrangement to the machine body and the rod end connected to a shoulder 7 that is part of and projects from the support arm 5. Operation of the piston cylinder assembly 8 thus pivots the support arm about shaft 6 to raise the cutter drum to a position where, as shown in FIG. 3, the drum operates to release coal from the mine face while passing along a path of travel at the mine roof. When traversing movement of the mining machine is reversed, then the piston and cylinder assembly 8 is actuated to pivot the support arm downwardly to a position where the cutting drum operates to release coal from the mine face along the path of travel at the mine floor.

A drive motor 9 is mounted to the support arm with the motor drive shaft extending into a hollow interior of the support arm where a gearing 10 is mounted onto the shaft, which gearing inturn meshes with other gearing spaced along the arm 5 in turn drivingly engaging gearing situated in the cutting drum for rotation thereof. In all embodiments of the invention shown in the drawings, the drive motor 9 is situated on the side of the support arm which is turned away from the cutting drum 3. Moreover, the drive motor is also located between the pivot axis formed by pivot 6 and the rotational axis 11 of the cutting drum 3. The motor is firmly mounted to the support arm such that it extends from the arm above the longwall conveyor. The motor is used to provide support by attachment thereto, for a jib 13 which provides support for an auxiliary cutting drum 12 on a front face of the jib which is turned away from the support arm 5. The jib is provided with an internal cavity wherein gearing 14 comprised of a plurality of meshing gear members to transmit rotation of the drive motor 9 to the auxiliary cutting drum. The width of the cutting drum 12 corresponds approximately to the inside width of the conveyor wherein the burden is transported.

Figure 1:
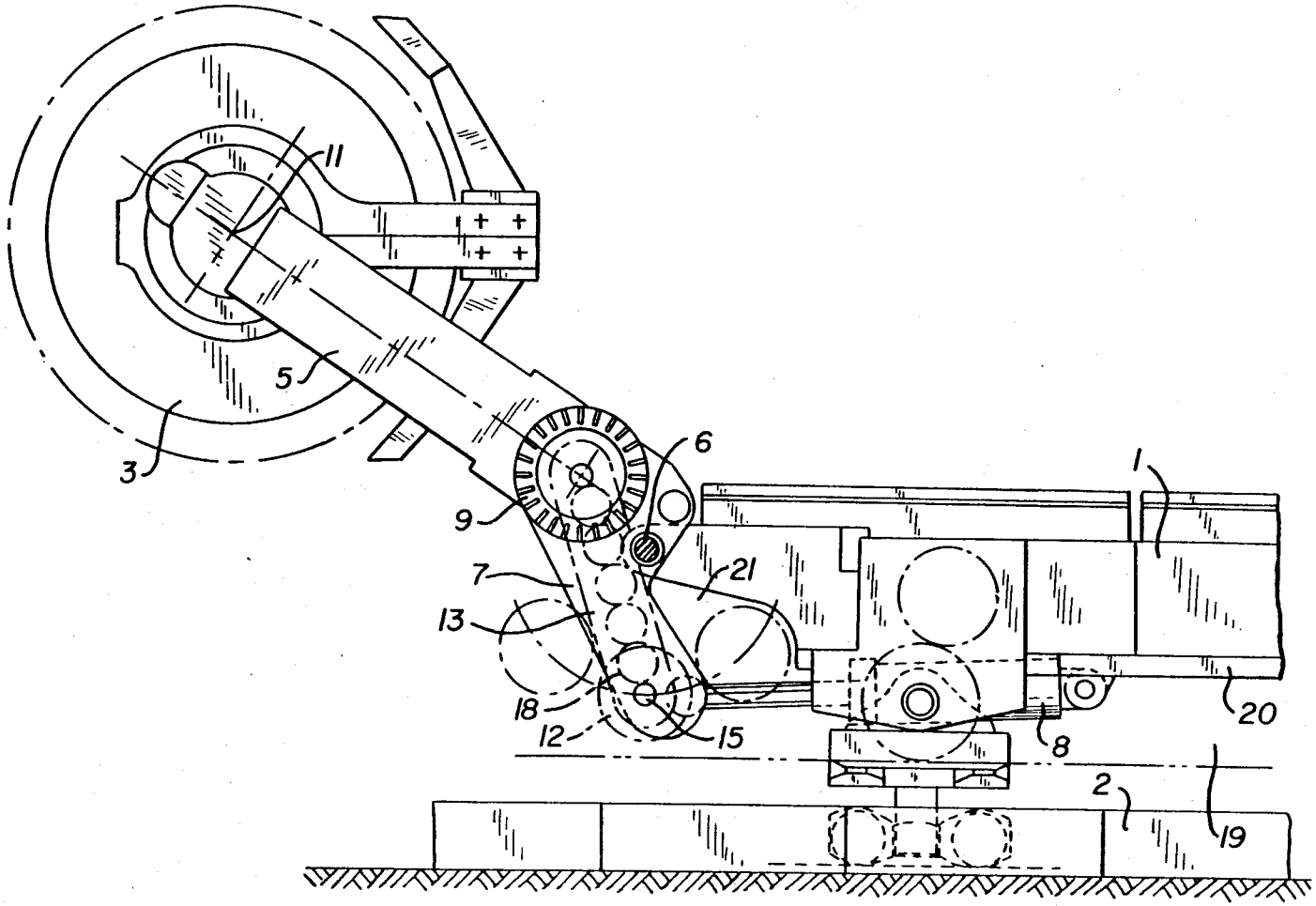
FIG. 1 is a partial elevational view of the drum-cutter mining machine according to one embodiment of the present invention.
Figure 2:
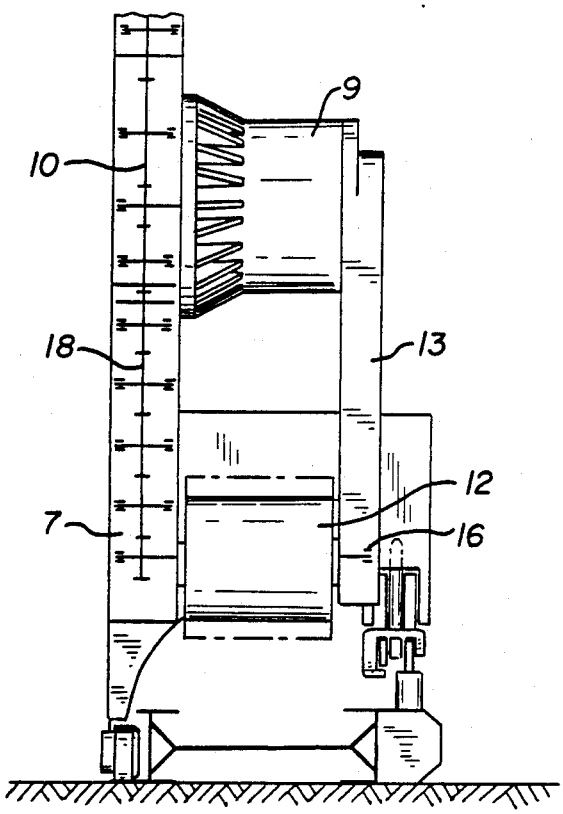
FIG. 2 illustrates a front view of the drum-cutter mining machine of FIG. 1.
Figure 5:
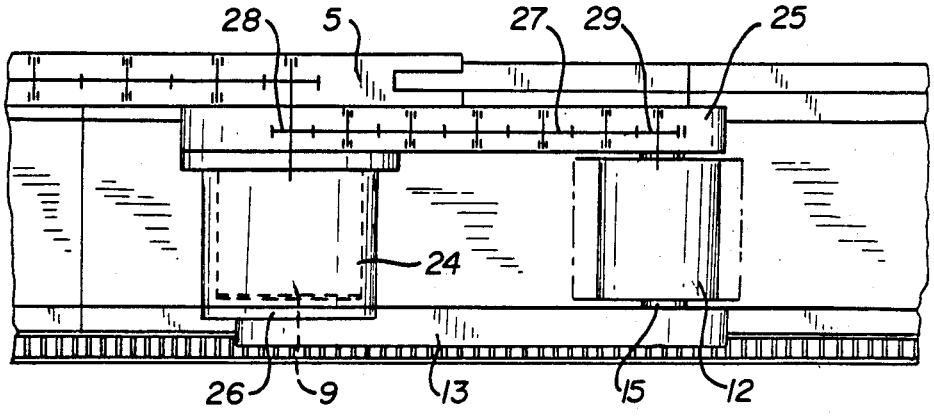
FIG. 5 is a plan view of a further embodiment of the present invention.
Figure 4:
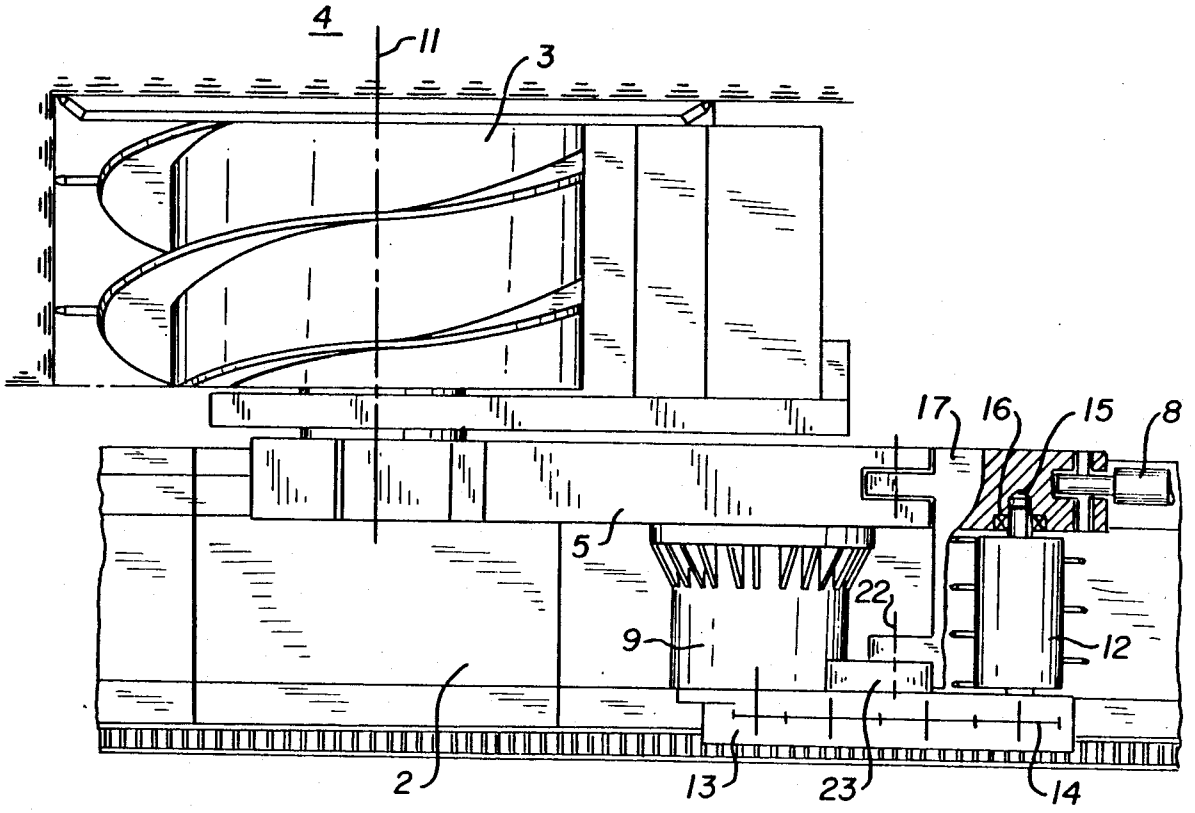
FIG. 4 is a plan view of the mining machine of FIG. 3.

In the illustrated embodiments of the invention of FIGS. 1, 4, and 5, the end portion of a shaft 15, used to support the auxiliary cutting drum 12 which is turned away from the jib 13, is supported by a roller bearing 16 that is in turn supported either by shoulder 7 (FIG. 1) or an extension 17 (FIG. 3) to the support arm. The shoulder 7 and support arm 5 can be formed as a single unitary component. However, if desired, shoulder 7 can be detachably connected to support arm 5. It is preferred to provide that gearing 18 (FIG. 1) which drivingly interconnects drive motor 9 with the auxiliary cutting drum 12 be arranged to extend in the shoulder 7 and not in the jib 13, particularly when the support arm 5 and the shoulder 7 comprise a unitary component. The jib 13 and shoulder 7 extend downwardly in a direction of the machine body. The length of the jib 13 and the length of the shoulder 7 are such that the auxiliary cutting drum 12 is situated underneath the pivot axis formed by pivot shaft 6 when the support arm of the cutting drum is located at a central position to the range X of pivotal movement. In the central position of support arm 5, the auxiliary cutting drum 12 forms a circular cutting path that is at least approximately tangent to the top edge of a bridge opening 19 in the machine frame 20.

As can be seen from the dot-lines, in FIG. 1, variations to the pivotal movement of the support arm according to the present invention, bring about only relatively small variations to the changes to the height of the auxiliary cutting drum which are brought about by the dimensioning of the length of the jib 13 and the support arm shoulder 7. Thus, it can be seen that the auxiliary cutting drum 12 is rotatably supported at a predetermined distance below the support arm because of the extended length of the jib 13 engaging one end of the cutting drum and the extended length of the support arm shoulder 7 engaging the other end of the cutting drum. This obviates the need for a special adjusting mechanism to correct positioning of the auxiliary cutting drum for operating at a desired height at a dependent relation to the particular angle to which a support arm is moved for locating the cutting drum at a desired operating site. The front face of the mining machine body, i.e., the portion of the machine body which traverses the conveyor above the material conveying section thereof is provided with surfaces forming an inlet 21 underneath the pivot axis formed by pivot pin 6. The depth of the inlet, i.e., height above the conveyor, starting from the pivot axis of pivot 6 is determined by the radius of the auxiliary cutting drum 12 and by the path of pivotal movement through which the auxiliary drum 12 moves when the support arm 5 is lowered to a lowermost operating position.

A mining machine embodying the features of the present invention is advantageous, particularly for drum-cutter loaders which are modified with parts to enable the use of the loader in thick mine seams. Equipment provided for such a mining machine includes a support arm extension 17. As illustrated in the embodiment shown in FIG. 3, for example, the drum-cutter loader 1 has been modified to provide the support arm 5 where a length suitable for use in thicker mine seams and to additionally provide that the support arm extension which is mounted on the machine body of the drum-cutter loader 1 for pivotal movement about a pivot axis defined by pivot 6. The support arm extension 17 is rigidly connected by bolts 22 to the support arm 5, and at the goaf side the arm is rigidly connected to lug 23 of the drive motor 9. This arrangement forms with the support arm 5 a component which can pivot about the pivot axis formed by pivot 6 and by which the operation of piston and cylinder assembly 8 acts on the support arm extension 17 connecting the rod end of the piston and cylinder assembly 8 to the support arm extension 17 as shown in FIG. 3. In this embodiment, the auxiliary cutting drum 12 situated above the longwall conveyor 2 is underneath the swivel axis 6, and hence in the area in which pivotal movement causes no significant variations to the position of the auxiliary cutting drum above the conveyor.

When increasing the cutting range of cutting drum 3 through the use of support arm extension 17, a corresponding increase in the length of shoulder 7 and jib 13 is required. Cutting drum 3 may be positioned at any of many vertical heights, including cutting heights identified by dot-dash lines A and B in FIG. 3. The allowable pivotal pivot range of support arm 5 is denoted by "X" in the Figure. The auxiliary cutting drum 12 is concurrently positioned at different location each time in which the cutting drum 3 is repositioned. In the illustration of FIG. 3, the auxiliary cutting drum 12 is positioned at locations indicated by circles of dot-and-dash lines A, and B, when cutting drum 3 is positioned at locations indicated by reference numeral A and B, respectively. In the embodiment of the present invention shown in FIG. 5, a support arm 5 is illustrated without a cutting drum and machine body which carries the arm. The drive motor 9 for the cutting drum is situated in a special protective housing 24. The housing is fastened to the sidewall of the support arm which is turned away from the coal face. The housing is provided with a radially projecting shoulder or housing extension 25 which rotatably supports one end of the auxiliary cutting drum 12. The jib 13 rotatably supports the other end of the auxiliary cutting drum by way of shaft 15 of the drum. The jib 13 is connected to a protective cover 26 forming a seal for the housing 24 and thereby forms a common structural unit. A train of gears 27, 29 is arranged in the housing extension 25 to drivingly interconnect the drive pinion 28 of dive motor 9 with drive shaft 15 of the auxiliary cutting drum.

While the present invention has been described in accordance with the preferred embodiments of the various figures, it is to be understood that other similar embodiments may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

What I claim is:

1. A drum cutter mining machine for releasing material from a thick mine seam while traversed along a conveyor, said drum cutter mining machine including the combination of:

a machine body including body portion traversing said conveyor above a material transportation portion while moving back and forth along said conveyor;

a support arm pivotally connected by pivotal to said machine body at an end thereof for leading and trailing with respect to movement of the machine body along said conveyor;

a cutting drum rotatably supported by an extended end portion of said support arm for releasing material from the mine seam;

a drive motor for rotating said cutting drum, said drive motor being supported above said conveyor by said support arm for allowing passage of debris on the conveyor beneath the drive motor and said body which bridges the conveyor;

a jib secured to a surface of said drive motor which is turned away from the support arm for support thereby;

an auxiliary cutting drum rotatably mounted at an extended end of said jib which projects from the drive motor;

gear means for drivingly interconnecting said drive motor and said auxiliary cutting drum;

said jib having an extended length such that the auxiliary drum is situated thereby below the axis of pivotal movement formed by said pivot when said support arm is in a central position to its range of pivotal movement ranging between operation of the cutting drum at the mine roof and at the mine floor; and means supported by said machine body and connected to said support arm for pivoting said support arm to locate the cutting drum carried thereby for operation at the roof of the mineral seam and at other times at the floor of the mineral seam, said auxiliary cutting drum being concurrently positioned by operation of said means from a position below the pivotal axis to operating positions where the operating height of the auxiliary cutting drum above the conveyor is substantially the same independently of whether the cutting drum is operating at the roof or the floor of the coal seam.

2. The drum-cutter mining machine according to claim 1 wherein the body portion of said machine body is formed to provide an inlet below the axis of pivotal movement by the support arm on the machine body, said inlet being dimensioned to extend in the longitudinal direction of the machine body into the body by a distance determined by the radius of said auxiliary cutting drum and the position to which the auxiliary cutting drum is displaced by positioning of said support arm to locate the cutting drum for operating at the floor of the coal seam.

3. The drum-cutter mining machine according to claim 1 further including a support arm extension having a portion projecting from the support arm for rotatably supporting an end of said auxiliary cutting drum which is turned away from said jib, the other end of said cutting drum being rotatably supported by said jib.

4. The drum-cutter mining machine according to claim 1 wherein said support arm is provided with a detachably connected shoulder for extending to the underside of the support arm under the pivot axis about which said support arm pivots on the machine body, said arm extension providing rotatable support for said auxiliary cutting drum.

5. The drum-cutter mining machine according to claim 4 wherein said support arm shoulder forms a single component with said support arm, said support arm shoulder forming housing means wherein said gear means is supported for drivingly engaging said auxiliary cutting drum.

6. The drum-cutter mining machine according to claim 1 further including a protective housing connected to said support arm and enclosing said drive motor, said housing including a shoulder adjacent to a sidewall of said support arm and extending therefrom a distance to receive and rotatably support one end of a drive shaft of said auxiliary cutting drum, said gear means being arranged in said housing to drivingly interconnect a butt shaft portion of said drive motor with the drive shaft portion of the auxiliary cutting drum supported by the housing, and a cover to seal said protective housing and engage with said jib for providing support for an end of the drive shaft of said auxiliary cutting drum which is opposite the end supported by said housing.

* * * * *